US010827785B2

(12) United States Patent
Beernink et al.

(10) Patent No.: US 10,827,785 B2
(45) Date of Patent: Nov. 10, 2020

(54) WOMEN'S ZIPPERED WADER

(71) Applicant: Simms Fishing Products LLC, Bozeman, MT (US)

(72) Inventors: Pat Beernink, Bozeman, MT (US); Clay Krull, Bozeman, MT (US)

(73) Assignee: Simms Fishing Products LLC, Bozeman, MT (US)

( * ) Notice: Subject to any disclaimer, the term of this patent is extended or adjusted under 35 U.S.C. 154(b) by 168 days.

(21) Appl. No.: 16/225,573

(22) Filed: Dec. 19, 2018

(65) Prior Publication Data

US 2020/0196688 A1 Jun. 25, 2020

(51) Int. Cl.
*A41D 13/012* (2006.01)
*A41F 3/00* (2006.01)

(52) U.S. Cl.
CPC ..... *A41D 13/012* (2013.01); *A41F 3/00* (2013.01); *A41D 2600/106* (2013.01)

(58) Field of Classification Search
CPC ..... A41D 13/012; A41D 2600/106; A41D 2600/108; A41D 31/06; A41D 31/10; A41D 2300/322; A41D 2400/44; A41F 3/00
USPC ..... 2/82, 81, 79, 94, 2.17, 230; D2/743
See application file for complete search history.

(56) References Cited

U.S. PATENT DOCUMENTS 848,821 A * 4/1907 Glidden ..... A41D 13/012 36/4
1,208,715 A * 12/1916 Bartrum ..... A41D 13/02 2/79
1,333,958 A * 3/1920 Boardman ..... A41D 13/02 2/79
1,365,766 A * 1/1921 Campbell ..... A41D 13/02 2/79
1,414,349 A * 5/1922 Fels ..... A41D 13/02 2/79
1,726,951 A * 9/1929 Evanove ..... A41D 13/02 2/227
1,986,792 A * 1/1935 Calvo ..... A41D 7/00 2/67
2,321,583 A * 6/1943 Craig ..... A41D 13/0125 441/106
2,385,816 A * 10/1945 Krupp ..... A44B 19/32 24/387
2,436,165 A * 2/1948 Forkish ..... A41D 11/00 2/80
2,605,470 A * 8/1952 Astrove ..... A41D 13/0002 2/80
3,493,972 A * 2/1970 Oldham ..... B63C 11/04 2/2.17
3,763,498 A * 10/1973 Rector ..... A41D 13/012 2/2.15
4,117,609 A * 10/1978 Helt ..... A41D 13/012 2/227
4,274,159 A * 6/1981 Schmidt ..... A41D 13/012 2/227

(Continued)

*Primary Examiner* — Alissa L Hoey
(74) *Attorney, Agent, or Firm* — Antoinette M. Tease

(57) ABSTRACT

A fishing wader having a chest piece, a back piece, and a waterproof zipper installed on a side of the wader between the chest piece and the back piece, the zipper extending substantially vertically from an armpit area of the wader to a horizontal seam between the chest and back pieces and one or more torso pieces, and the zipper opening in a downward direction from the armpit area.

1 Claim, 10 Drawing Sheets

(56) References Cited

U.S. PATENT DOCUMENTS 4,888,830 A * 12/1989 Putnam ..... A41F 3/02 2/327
5,081,718 A * 1/1992 Carman ..... A41D 1/06 2/227
RE33,966 E * 6/1992 Robison ..... A41D 13/02 2/227
5,359,731 A * 11/1994 Cavalier ..... A41D 1/06 2/227
5,511,245 A * 4/1996 Hayes ..... A41D 13/00 2/272
5,617,581 A * 4/1997 Robbins ..... A41B 9/00 2/234
5,628,064 A * 5/1997 Chung ..... A41D 15/00 2/119
5,867,828 A * 2/1999 Shih ..... A41D 31/02 2/82
5,896,582 A * 4/1999 Baacke ..... A41D 1/08 2/79
6,026,516 A 2/2000 Dacyshyn
6,219,841 B1 * 4/2001 Anderson ..... B63C 11/04 2/2.17
6,317,893 B1 * 11/2001 Walton ..... A41D 13/012 2/227
6,363,531 B1 * 4/2002 Quinn ..... A41D 13/012 2/227
D593,281 S * 6/2009 Pitchforth ..... D2/743
D598,181 S * 8/2009 Rowe ..... D2/743
3,020,546 A1 8/2013 McClintock et al.
8,819,864 B2 * 9/2014 Hare ..... A41D 13/012 2/79
8,819,865 B1 * 9/2014 Crye ..... A41D 13/02 2/79
D785,910 S * 5/2017 Maples ..... D2/860
D809,743 S * 2/2018 Meng ..... D2/743
D825,145 S * 8/2018 Fowler ..... D2/743
D870,420 S * 12/2019 Beernink ..... D2/743
2001/0025383 A1 * 10/2001 Thompson ..... A41D 13/02 2/69
2004/0133960 A1 * 7/2004 Rausch ..... A41D 13/02 2/69
2008/0040837 A1 * 2/2008 King ..... A41D 13/012 2/227
2009/0055990 A1 * 3/2009 Shih ..... A41D 27/28 2/79
2009/0100557 A1 * 4/2009 Insulan ..... B63C 11/04 2/2.17
2010/0162462 A1 * 7/2010 Shih ..... B29C 65/5042 2/82
2011/0307993 A1 * 12/2011 McAfee ..... A41D 15/002 2/82
2013/0152263 A1 6/2013 Hare
2014/0130230 A1 * 5/2014 Blinka ..... A41F 9/025 2/82
2015/0289578 A1 * 10/2015 Davis ..... A41D 13/012 2/271
2015/0342272 A1 12/2015 Bonime et al.
2016/0360804 A1 * 12/2016 Beltramo ..... A43C 11/1493
2017/0027235 A1 * 2/2017 Inzer ..... A41D 13/0015
2017/0027246 A1 * 2/2017 Inzer ..... A41D 13/0015
2017/0295859 A1 * 10/2017 Butler ..... A41D 13/0017
2020/0121000 A1 * 4/2020 Wood ..... A41D 13/02

* cited by examiner

WOMEN'S ZIPPERED WADER

BACKGROUND OF THE INVENTION

1. Field of the Invention

The present invention relates to women's wader garments, and more particularly, to a wader comprising a side zipper.

2. Description of the Related Art

The present invention is a women's breathable waterproof wader that is tailored to fit the female figure and which incorporates a side zipper and specialized suspenders. The side zipper allows the wader to be made with a trim fit, and the zipper in combination with the specialized suspenders enable the wader to be partially removed for the purposes of defecation and urination (hereafter referred to as "performing bathroom functions"). Although there are numerous examples of issued patents, patent applications, and non-patented commercial wader products, none of these products incorporates the structural features of the present invention.

U.S. Pat. No. 6,026,516 (Dacyshyn, 2000) discloses a pair of suspenders having two pants attachment points, and that comprise a pair of hook-and-loop fasteners that are designed to removably attach to the front and rear panels of certain pants (such as some snow pants) that have zippers manufactured into two sides of the pants to removably attach the front and rear panels of pants. The hook-and-loop attachments of the invention are designed to be compatible with the hook and loop waist connectors of some commercially available snow pants.

U.S. Pat. No. 8,819,864 (Hare, 2014) discloses a wader that comprises a single shoulder strap and one or two associated adapter straps that attach to each other and also to two, three or four locations on the wader (either one or two locations in the rear of the wader and one or two locations in the front of the wader). The wader does not comprise a zipper and is not designed to be easily removed by the user to perform bathroom functions. The invention optionally incorporates side stretch panels to help the top of the wader conform to the body shape of the user.

U.S. Patent Application Pub. No. 2013/0205465 (McClintock et al., 2013) discloses a fishing or hunting wader comprising an outer breathable layer, a center insulated layer, and an inner waterproof lining. The waders of this invention do not incorporate a zipper or other feature designed to facilitate partial removal of the waders to perform bathroom functions.

U.S. Patent Application Pub. No. 2015/0342272 (Bonime et al., 2015) discloses a trouser garment such as a wader that comprise's a quick-release drop-seat portion that can be lowered for bathroom functions without completely removing the wader or other clothing such as outer jackets. The invention incorporates a Y-shaped suspender assembly having two attachment points to the front of the wader and a single rear attachment point. Unlike the present invention that incorporates a front-release buckle, the drop seat of this invention is lowered by the user by un-attaching a rear quick-release attachment buckle that connects the suspender rear attachment point to the rear of the wader. With this system, the user does not have the ability to visually observe the rear quick-release buckle, and must rely on his or her sense of touch. In order to aid the user in re-attaching the quick release buckle, the wader may incorporate a loop of fabric fastened to the wader above the wader portion of the quick-release buckle, which guides the hand of the user (which is holding the suspender portion of the buckle) to the location of the wader portion of the buckle. The wader does not incorporate a zipper or other opening to separate the front and rear portions of the wader for performing bathroom functions.

BRIEF SUMMARY OF THE INVENTION

The present invention is a fishing wader comprising: a chest piece; a right back piece; a left back piece; a first suspender assembly; and a second suspender assembly; wherein the first suspender assembly comprises a front end that is connected to a top portion of a right side of the chest piece and a back end that is connected to an inside surface of a the left back piece; wherein the second suspender assembly comprises a front end that is connected to a top portion of a left side of the chest piece and a back end that is connected to an inside surface of the right back piece; and wherein a waterproof zipper is installed between a left side of the chest piece and a left side of the left back piece. In a preferred embodiment, the chest piece comprises a top left edge and a bottom left edge, the left back piece comprises a top left edge and a bottom left edge, and the waterproof zipper extends from the top left edges of the chest piece and left back piece to the bottom left edges of the chest piece and left back piece.

In a preferred embodiment, the first suspender assembly comprises a first quick-release buckle, a first attachment loop, a first suspender strap, and a first length adjustment buckle; and the second suspender assembly comprises a second quick-release buckle, a second attachment loop, a second suspender strap, and a second length adjustment buckle. Preferably, a first seam is situated between the waterproof zipper and a left edge of the left back piece, a second seam is situated between a right edge of the chest piece and a right edge of the right back piece, and the first seam is directly opposite the second seam.

In a preferred embodiment, the waterproof zipper opens at a top end of the zipper and unzips in a downward direction, and the top end of the zipper is situated in an armpit region of the wader. Preferably, the waterproof zipper is installed at an angle of about 75 degrees as measured between the first seam and a top surface of the wader. In another preferred embodiment, the wader comprises a top opening formed by the chest piece, the right back piece, the left back piece, and the waterproof zipper; the chest piece, the right back piece, the left back piece, and the waterproof zipper each has a top edge with a length; the top opening has a circumference that is equal to a sum of the lengths of the top edges of the chest piece, the right back piece, the left back piece, and the waterproof zipper; and a sum of the lengths of the top edges of the right back piece and the left back piece is greater than a sum of the lengths of the top edges of the waterproof zipper and chest piece. Preferably, the waterproof zipper has a top edge that is forward of a vertical centerline of the left side of the top of the wader.

In a preferred embodiment, the invention further comprises a wader belt a right belt loop that is attached to a lower right side of the right back piece and a left belt loop that is attached to a lower left side of the left back piece; wherein the left belt loop is positioned behind the waterproof zipper; and wherein the right belt loop is positioned behind the second seam. Preferably, the first suspender strap comprises a rear terminal end that is connected to an upper end of a first strap replacement buckle; a lower end of the first strap replacement buckle is connected to a third attachment loop;

the third attachment loop is located on a left central side of the left back piece; the second suspender strap comprises a rear terminal end that is connected to an upper end of a second strap replacement buckle; a lower end of the of the second strap replacement buckle is connected to a fourth attachment loop; the fourth attachment loop is located on a right central side of the right back piece; a piece of webbing is attached to the top edges of the center portions of the right back piece and left back piece to form a slot through which the first suspender strap and the second suspender strap pass; and the slot is wider than the first and second suspender straps, thereby allowing the first and second suspender straps to slide laterally back and forth within the slot. Preferably, the first quick-release buckle comprises a female half and a male half; the second quick-release buckle comprises a female half and a male half; the female half of the first quick-release buckle is attached to the chest piece; and the male half of the second quick-release buckle is attached to the chest piece.

In an alternate embodiment, the present invention is a fishing wader comprising: a chest piece; a right back piece; a left back piece; a first suspender assembly; and a second suspender assembly; wherein the first suspender assembly comprises a front end that is connected to a top portion of a right side of the chest piece and a back end that is connected to an inside surface of a the left back piece; wherein the second suspender assembly comprises a front end that is connected to a top portion of a left side of the chest piece and a back end that is connected to an inside surface of the right back piece; and wherein a waterproof zipper is installed between a right side of the chest piece and a right side of the right back piece.

In a preferred embodiment, the present invention is a fishing wader comprising a chest piece, a back piece, and a waterproof zipper installed on a side of the wader between the chest piece and the back piece, the zipper extending substantially vertically from an armpit area of the wader to a horizontal seam between the chest and back pieces and one or more torso pieces, and the zipper opening in a downward direction from the armpit area.

REFERENCE NUMBERS

Figure 1:
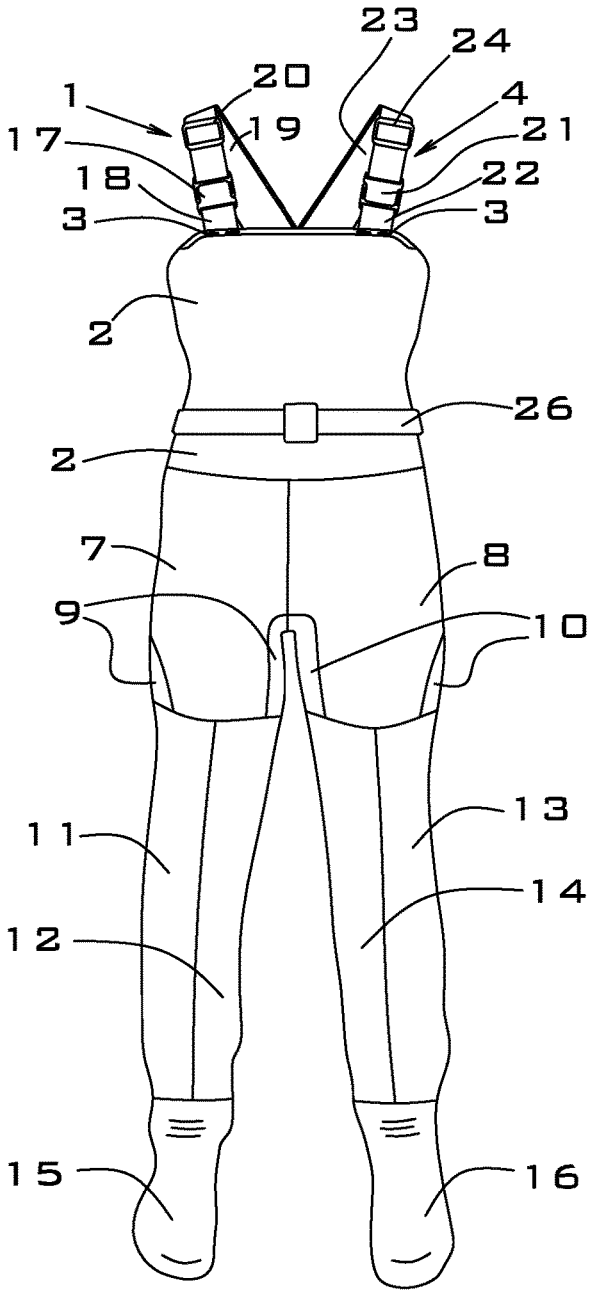
FIG. 1 is a front view of the present invention.

1 First suspender assembly
2 Chest piece
3 Stitching
4 Second suspender assembly
5 Right back piece
6 Left back piece
7 Right lower front torso piece
8 Left lower front torso piece
9 Right lower back torso piece
10 Left lower back torso piece
11 Right outer leg piece
12 Right inner leg piece
13 Left inner leg piece
14 Left outer leg piece
15 Right bootie
16 Left bootie
17 First quick-release buckle
18 First attachment loop
19 First suspender strap
20 First length adjustment buckle
21 Second quick-release buckle
22 Second attachment loop
23 Second suspender strap
24 Second length adjustment buckle
25 Zipper
26 Wader belt
27 Right belt loop
28 Left belt loop
29 First strap replacement buckle
30 Third attachment loop
31 Second strap replacement buckle
32 Fourth attachment loop
33 Webbing

34 Slot formed by webbing
35 Male half of second quick-release buckle
36 Female half of second quick-release buckle
37 Jacket
38 Optional pocket back
39 Hand-access opening
40 Chest piece (prior art)
41 Optional pocket back (prior art)
42 Upper back torso piece (prior art)
43 Left lower front torso piece (prior art)
44 Right lower front torso piece (prior art)
45 Left yoke piece (prior art)
46 Right yoke piece (prior art)
47 Left lower back torso piece (prior art)
48 Right lower back torso piece (prior art)
49 Right outer leg piece (prior art)
50 Right inner leg piece (prior art)
51 Left inner leg piece (prior art)
52 Left outer leg piece (prior art)
53 Internal zipper flap cover
54 Top flap of the internal zipper flap cover
55 Strip of adhesive
56 Zipper teeth
57 Pull tab of zipper
58 Interior face of snap closure
59 Exterior face of snap closure

DETAILED DESCRIPTION OF INVENTION

Figure 2:
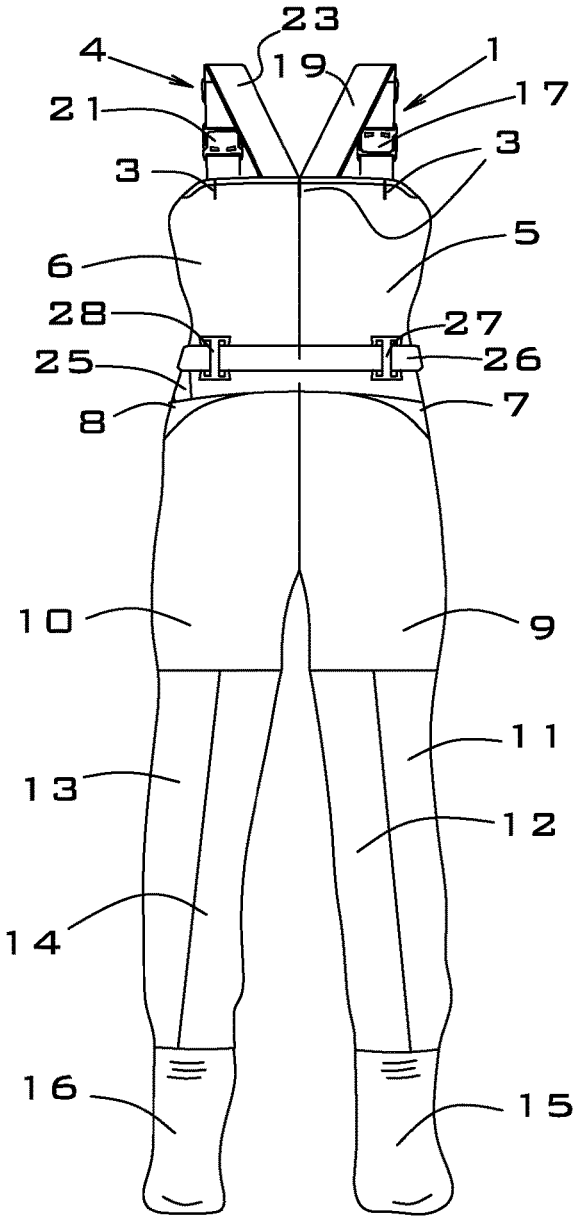
FIG. 2 is a rear view of the present invention.
Figure 3:
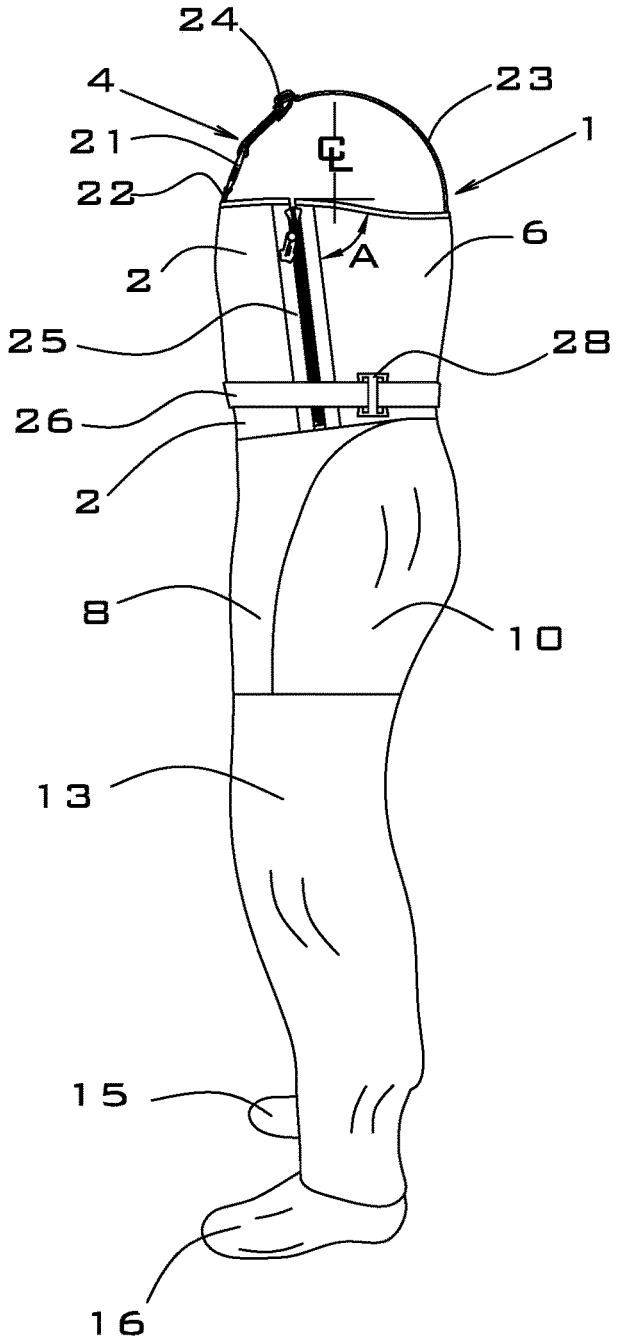
FIG. 3 is a left side view of the present invention.
Figure 4:
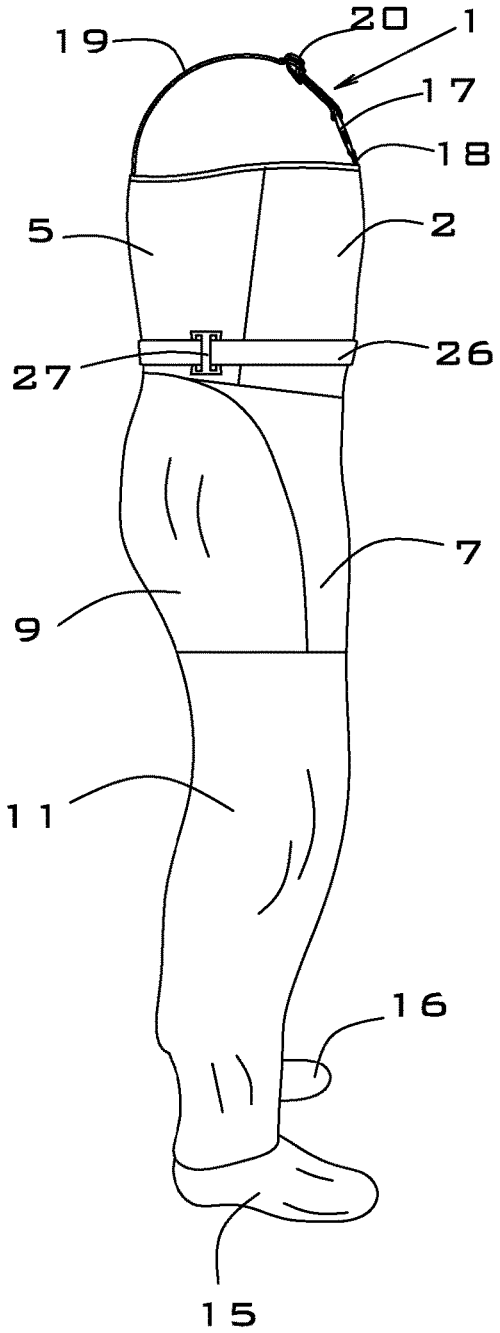
FIG. 4 is a right side view of the present invention.

The terms "right" and "left" refer to the wader wearer's right and left sides, respectively. FIG. 1 is a front view of the present invention. FIG. 2 is a rear view of the present invention. FIG. 3 is a left side view of the present invention. FIG. 4 is a right side view of the present invention. Referring to FIGS. 1 through 4, the present invention comprises a first suspender assembly 1 having a front end that is connected to the top portion of the right side of a chest piece 2 with stitching 3, and a second suspender assembly 4 having a front end that is connected to the top portion of the left side of the chest piece 2 by stitching 3. The back end of the second suspender assembly 4 is connected to the inside surface of a right back piece 5, and the back end of the first suspender assembly 1 is connected to the inside surface of a left back piece 6. (The connections of the back ends of the first and second suspender assemblies 1, 4 are shown in detail in FIGS. 5A and 5B.) Note that the right and left back pieces 5, 6 may be separate pieces of fabric or the same piece of fabric.

The bottom edge of the right side of the chest piece 2 is connected to the top edge of a right lower front torso piece 7, and the bottom edge of the left side of the chest piece 2 is connected to the top edge of a left lower front torso piece 8. The upper inside edge of the right lower front torso piece 7 is connected to the upper inside edge of the left lower front torso piece 8. The outside edge of the right lower front torso piece 7 is connected to the outside edge of a right lower back torso piece 9. The outside edge of the left lower front torso piece 8 is connected to the outside edge of a left lower back torso piece 10. The bottom edge of the right back piece 5 is connected to the top edge of the right lower back torso piece 9, as shown in FIG. 2, and also to a small portion of the top of the right lower front torso piece 7, as shown in FIG. 4. The bottom edge of the left back piece 6 is connected to the top edge of the left lower back torso piece 10, as shown in FIG. 2, and also to a small portion of the top of the left lower front torso piece 8, as shown in FIG. 3.

Portions of the right lower back torso piece 9 and the left lower back torso piece 10 form the crotch section of the wader, and these portions connect to the lower inside edge of the right lower front torso piece 7 and the lower inside edge of the left lower front torso piece 8, respectively, as shown in FIG. 1. The top edge of a right outer leg piece 11 is connected to the outer portion of the bottom edge of the right lower front torso piece 7 and the outer portion of the bottom edge of the right lower back torso piece 9. A right inner leg piece 12 is connected to the inner portion of the bottom edges of the right lower front torso piece 7 and the inner portion of the bottom edge of the right lower back torso piece 9. The top edge of a left outer leg piece 13 is connected to the outer portion of the bottom edge of the left front lower torso piece 8 and to the outer portion of the bottom edge of the left lower back torso piece 10. A left inner leg piece 14 is connected to the inner portion of the bottom edge of the left front lower torso piece 8 and the inner portion of the bottom edge of the left lower back torso piece 10.

The front edge of the right outer leg piece 11 is attached to the front edge of the right inner leg piece 12. The back edge of the right outer leg piece 11 is attached to the back edge of the right inner leg piece 12. The front edge of the left outer leg piece 13 is attached to the front edge of the left inner leg piece 14. The back edge of the left outer leg piece 13 is attached to the back edge of the left inner leg piece 14. The bottom edges of the right outer leg piece 11 and the right inner leg piece 12 are connected to the top edge of a right bootie 15. The bottom edges of the left outer leg piece 13 and the left inner leg piece 14 are connected to the top edge of a left bootie 16. With the exception of the bootie, the pieces of fabric described above are preferably manufactured from breathable waterproof material. The attachments between the pieces of fabric are preferably made by stitching that is covered with waterproof tape.

The first suspender assembly 1 comprises a first quick-release buckle 17, a first attachment loop 18, a first suspender strap 19, and a first length adjustment buckle 20. The second suspender assembly 4 comprises a second quick-release buckle 21, a second attachment loop 22, a second suspender strap 23, and a second length adjustment buckle 24. The first and second suspender straps 19, 23 are preferably manufactured from an elastic material.

As shown best in FIG. 3, a waterproof zipper 25 is installed between the left side of the chest piece 2 and the left side of the left back piece 6, and extends from the top left edges of the chest piece 2 and the left back piece 6 to the bottom left edges of the chest piece 2 and the left back piece 6. The right back piece 5 and the left back piece 6 are mirror images of each other, thereby causing the seam between the rear edge of the zipper 25 and the left edge of the left back piece 6 (shown in FIG. 3) to be directly opposite the seam between the right edge of the chest piece 2 and the right edge of the right back piece 5 (shown in FIG. 4) when the present invention is viewed from the side. The zipper 25 opens from the top and unzips in a downward direction. In a preferred embodiment, the zipper has a length of about 12.5 inches and is installed at an angle A of about seventy-five (75) degrees measured from the top surface of the wader to the seam between the zipper and the left back piece, as shown in FIG. 3. The zipper 25 is installed on the left side of the wader in order to minimize possible interference with fly casting activities (e.g., tangling of the fly line with the zipper pull tab) conducted by the majority of wearers, who cast with the right hand. The left side position of the zipper also enables a right-hander wearer to easily reach behind the head with the right hand, move the left suspender assembly behind the head, and reposition it over the right shoulder in order to perform bathroom functions, as described in detail in reference to FIGS. 7A, 7B, and 7C.

Figure 10:
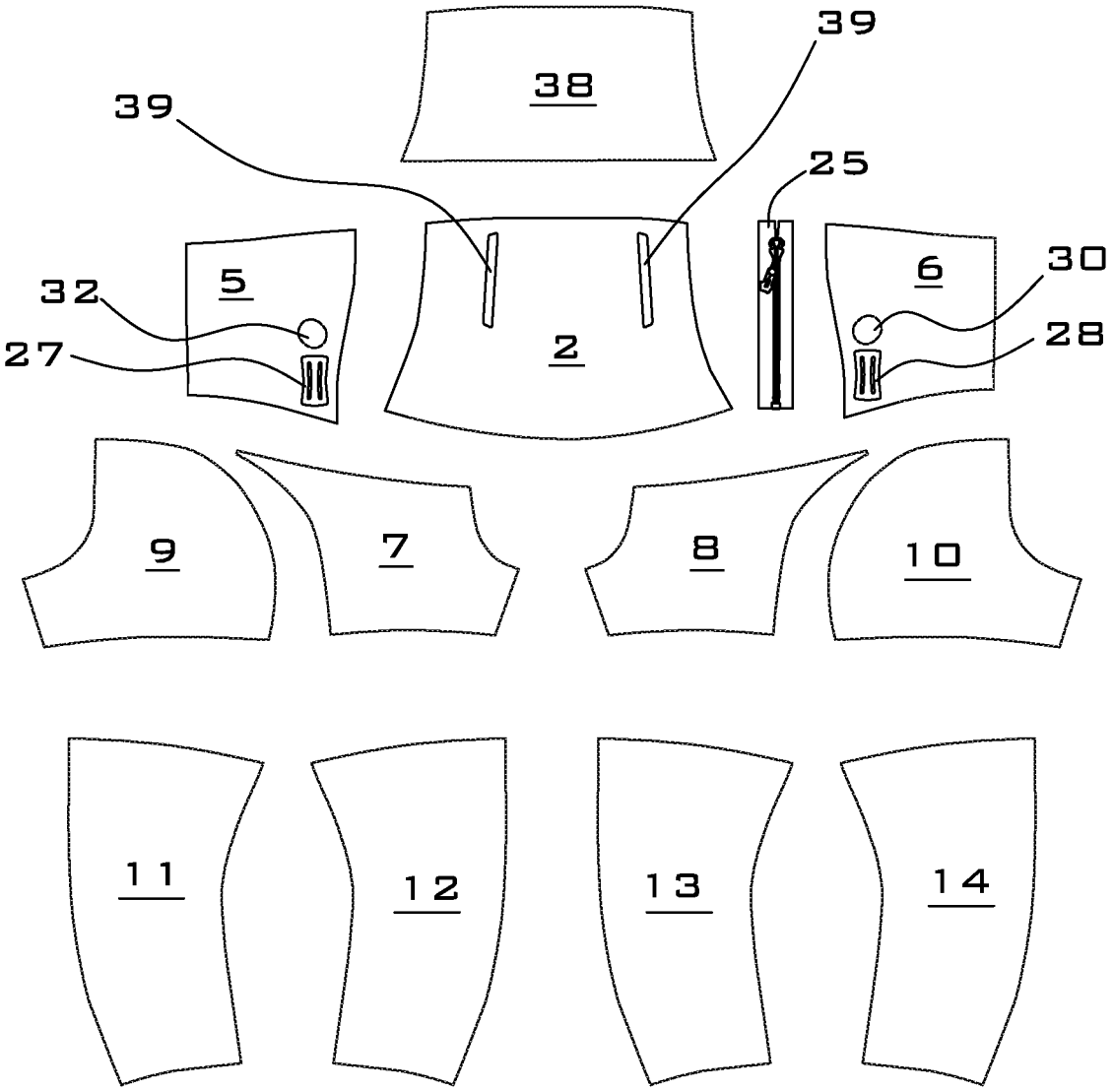
FIG. 10 is a pattern layout showing the fabric pieces of the present invention laid flat and positioned relative to each other as when just prior to being sewn together.

The top opening of the present invention is generally oval in shape when the present invention is being worn, and this top opening has a circumference that is equal to the sum of the lengths of the top edges of the chest piece 2, the right back piece 5, the left back piece 6, and the zipper 25. In a preferred embodiment, the sum of the lengths of the top edges of the right back piece 5 and the left back piece 6 is greater than the sum of the lengths of the top edges of the zipper 25 and the chest piece 2, as best shown in FIG. 10. This preferred selection of lengths of top edges of the pieces forming the top opening results in the zipper 25 having a top edge that is slightly forward of the vertical centerline of the left side of the top of the present invention, as shown in FIG. 3. This position of the top of the zipper 25, which is slightly forward of the armpit of the wearer, allows the zipper to be easily reached by the wearer with the left hand for unzipping and zipping.

Figure 9:
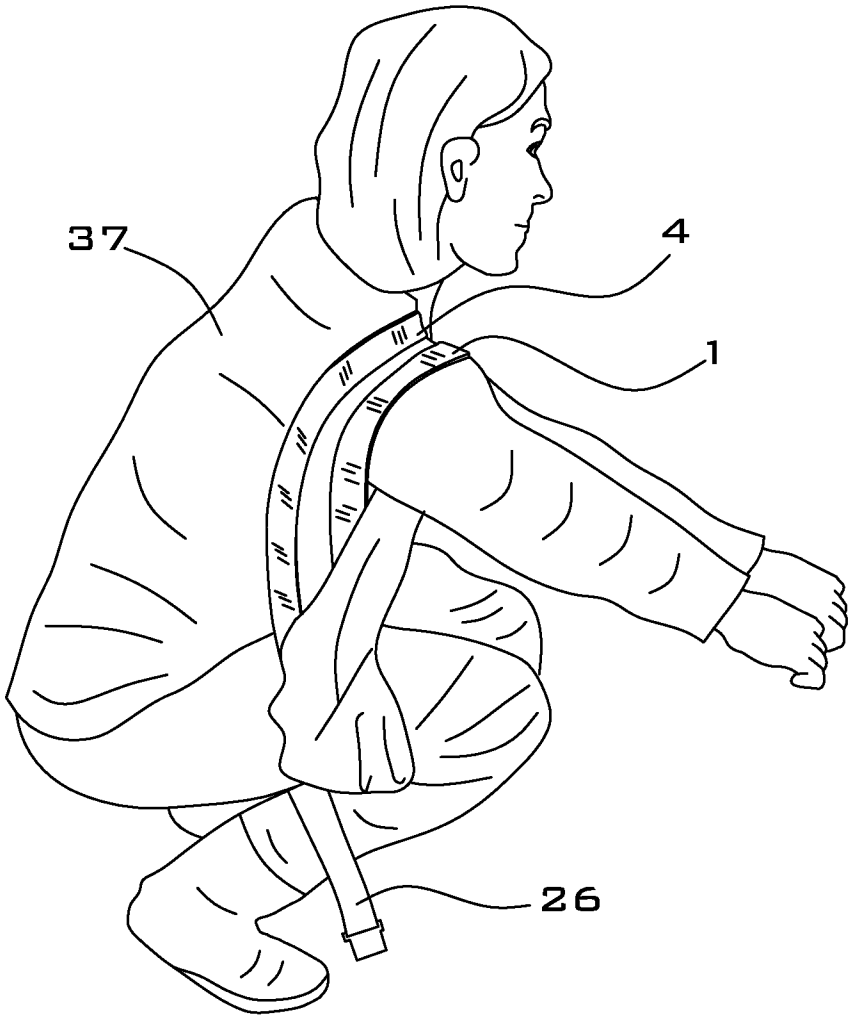
FIG. 9 is a right side view that illustrates the position of the present invention when it has been partially removed and the wearer has assumed a squatting position in order to perform bathroom functions.
Figure 8:
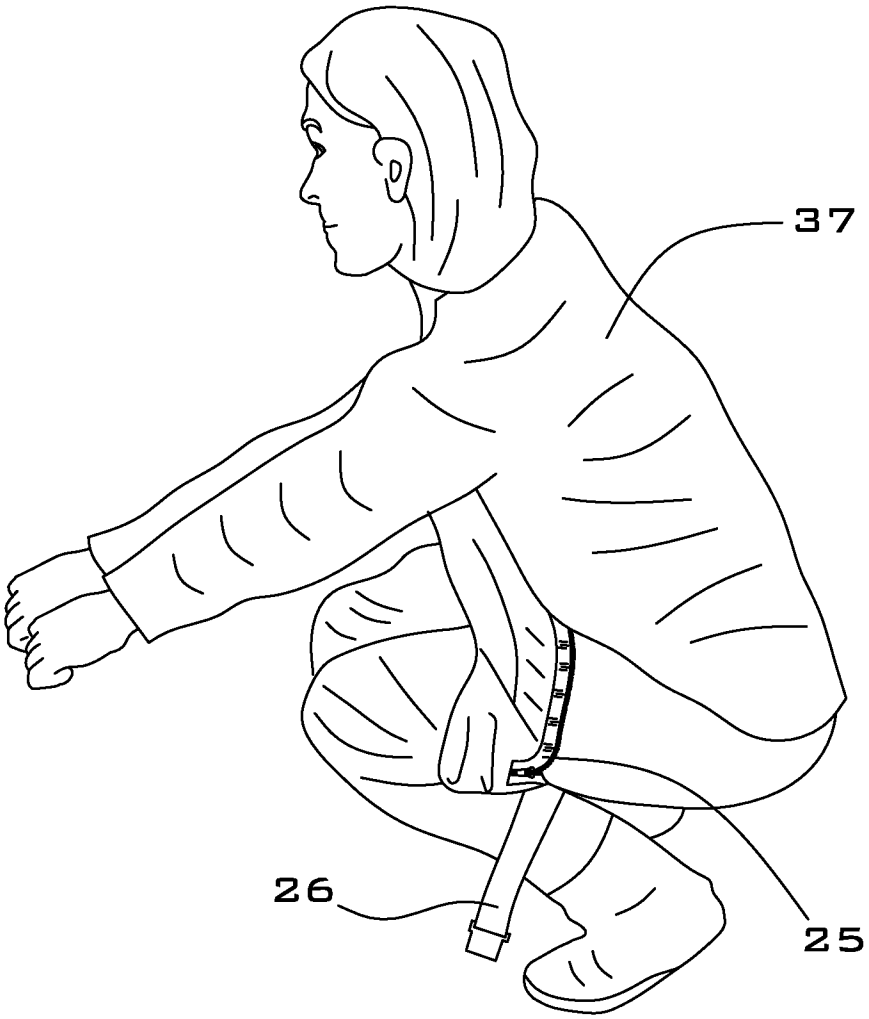
FIG. 8 is a left side view that illustrates the position of the present invention when it has been partially removed and the wearer has assumed a squatting position in order to perform bathroom functions.

The zipper 25 has two major purposes. First, it enables the wader to be tailored with a waist section that is narrower than the hip section, since the wader can be pulled over the hips with the zipper 25 open, and then the zipper 25 can be closed once the wader is fully donned. This provides a less bulky and more comfortable fit for the user, and provides a trimmer fit for outer jackets that are worn over the wader. Second, by unzipping the zipper 25, the wearer can partially remove the wader by pulling the wader down over the buttocks, thereby enabling the wearer to sit on a toilet seat or squat on the ground in order to perform bathroom functions, without the wearer being required to fully remove the wader or to remove outer jackets (as illustrated in FIGS. 8 and 9). A first example of a suitable commercially available zipper is the TIZIP model MAR-BS-00280-50-25, and second example is the TIZIP model MAR-BS-00300-50-25, both manufactured by Titex Vertriebs-GmbH of Heilsbronn, Germany. A third example of a suitable zipper is the YKK Model 10V manufactured by YKK North America of Atlanta, Ga. An interior zipper flap cover is described in reference to FIGS. 14 and 15. The zipper flap cover is omitted in the other drawings for clarity.

As shown in FIG. 4, the right edge of the chest piece 2 is connected to the right edge of the back piece 5. An optional wader belt 26 may be attached to the wader by running the wader belt 26 through a right belt loop 27 and a left belt loop 28 that are attached to the lower right side of the right back piece 5 and the lower left side of the left back piece 6, respectively, as shown in FIGS. 3 and 4. The left belt loop 28 is positioned behind the zipper as shown in FIG. 3, so that the zipper 25 may be easily unzipped when the wader belt has been opened and is being retained by the belt loops 27, 28. The belt loops 27 and 28 are preferably attached to the right and left back pieces 5, 6 with adhesive. The precise locations of the belt loops 27, 28 with respect to the right and left back pieces 5, 6 are shown on FIG. 10.

Figure 5B:
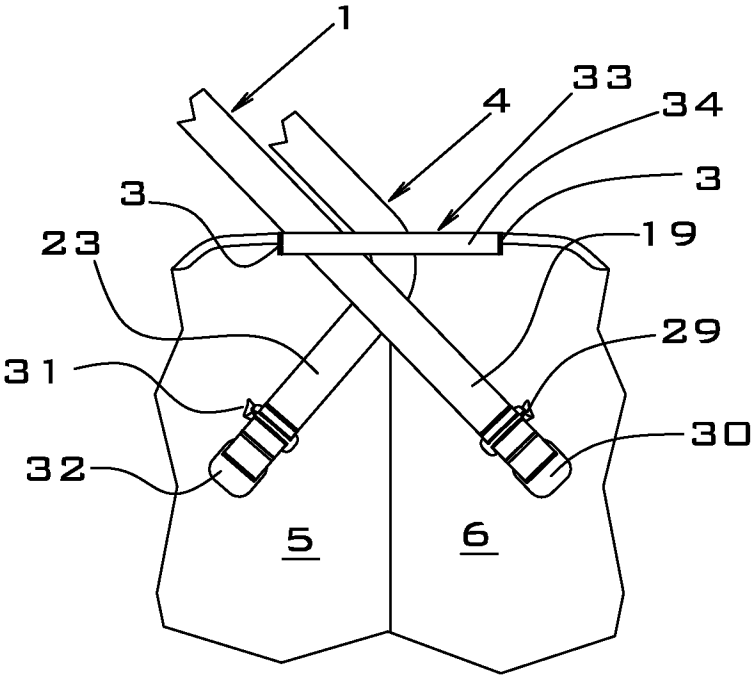
FIG. 5B is a cut-away view of portions of the interior surfaces of the right back piece and the left back piece that illustrates the positions of the first and second suspender straps when the wader is being worn in the auxiliary position (i.e., both suspender straps positioned over the right shoulder of the wearer).
Figure 5A:
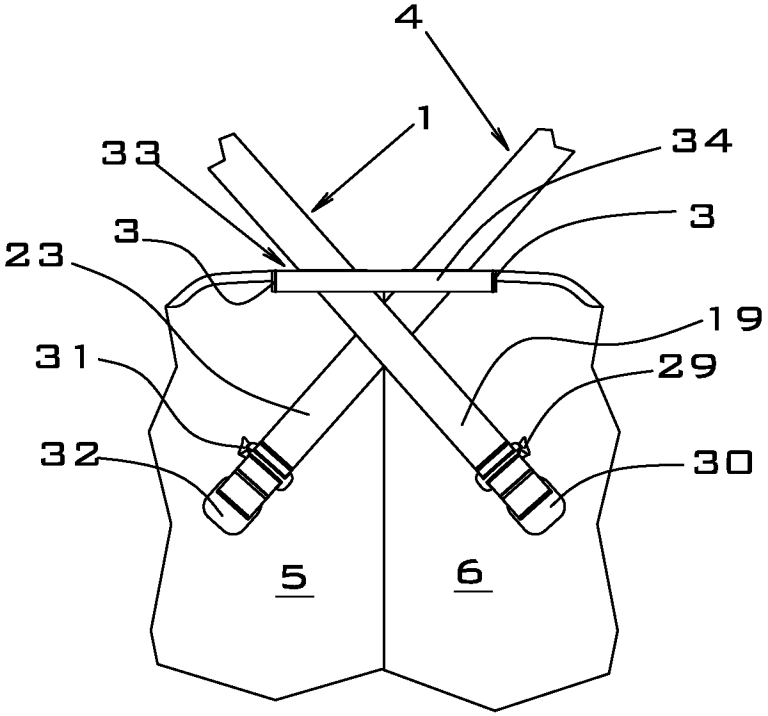
FIG. 5A is a cut-away view of portions of the interior surfaces of the right back piece and the left back piece that illustrates the positions of the first and second suspender straps when the wader is being worn normally (i.e., one strap over each shoulder of the wearer).

FIGS. 5A and 5B are cut-away views showing the interior surfaces of portions of the right back piece 5 and the left back piece 6, and the rear portions of the first suspender assembly 1 and the second suspender assembly 4. These figures show the specialized rear attachments of the first suspender assembly 1 to the left back piece 6 and the second suspender assembly 4 to the right back piece 5. As shown, the rear terminal end of the first suspender strap 19 is connected to the upper end of a first strap replacement buckle 29, and the lower end of the first strap replacement buckle 29 is connected to a third attachment loop 30. The third attachment loop 30 is located on the left central side of the left back piece 6 (with the precise location shown on FIG. 10), and is preferably attached to the interior surface of the left back piece 6 by adhesive. The rear terminal end of the second suspender strap 23 is connected to the upper end of a second strap replacement buckle 31, and the lower end of the second strap replacement buckle 31 is connected to a fourth attachment loop 32. The fourth attachment loop 32 is located on the right central side of the right back piece 5 (with the precise location shown on FIG. 10), and is preferably attached to the interior surface of the right back piece 5 by adhesive.

A piece of webbing 33 is stitched to the top edges of the center portions of the right back piece 5 and the left back piece 6 with vertical rows of stitching 3 on the left side and the right side of the webbing 33. As shown, the stitched webbing 33 forms a slot 34 through which the first suspender strap 19 and the second suspender strap 23 pass. The slot 34 is wider than the first and second suspender straps 19, 23, allowing the first and second suspender straps 19, 23 to slide laterally back and forth within the slot 34.

FIG. 5A illustrates the positions of the first and second suspender straps 19, 23 within the slot 34 when the wader is being worn normally (i.e., one strap over each shoulder of the wearer). FIG. 5B illustrates the positions of the suspender straps 19, 23 in an auxiliary position, with both suspender assemblies 1, 4 positioned so as to fit over the right shoulder of a wearer, as would occur when the wearer is performing bathroom functions. In this position, the first and second suspender straps 19, 23 have been slid laterally within the slot 34 toward the wearer's right, as shown in FIG. 5B. The first and second strap replacement buckles 29, 31 are opened only for removal or replacement of the first and second suspender assemblies 1, 4, and are not opened during normal donning or removal of the wader by a wearer. One example of a commercially available buckle that is suitable for use as the first and second strap replacement buckles 29, 31 is the W819 Double Gate Keeper 38 buckle manufactured by Woojin Plastics of Korea (woojinplastics.com).

Figure 6B:
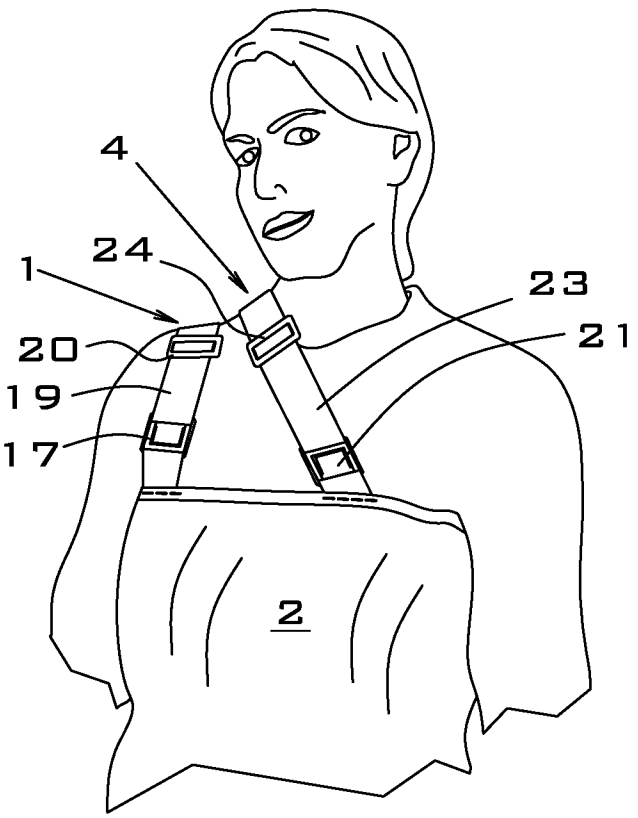
FIG. 6B is a partial front view of the present invention being worn in the auxiliary position.
Figure 6A:
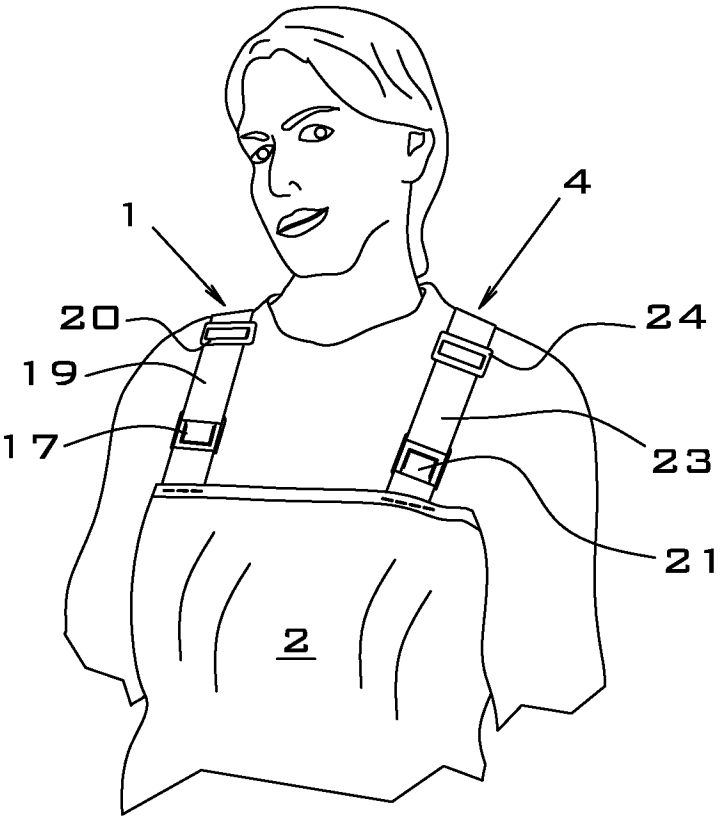
FIG. 6A is a partial front view of the present invention being worn in the normal position.

FIG. 6A is a partial front view of the present invention being worn, illustrating the positions of the first and second suspender assemblies 1, 4 over the right and left shoulders, respectively, of a wearer when the suspender assemblies 1, 4 are in the normal position. FIG. 6B is a partial front view of the present invention being worn, illustrating the positions of the first and second suspender assemblies 1, 4, with both first and second suspender assemblies 1, 4 positioned over the right shoulder of the wearer, when the suspender assemblies 1, 4 are in the auxiliary position.

Figure 7C:
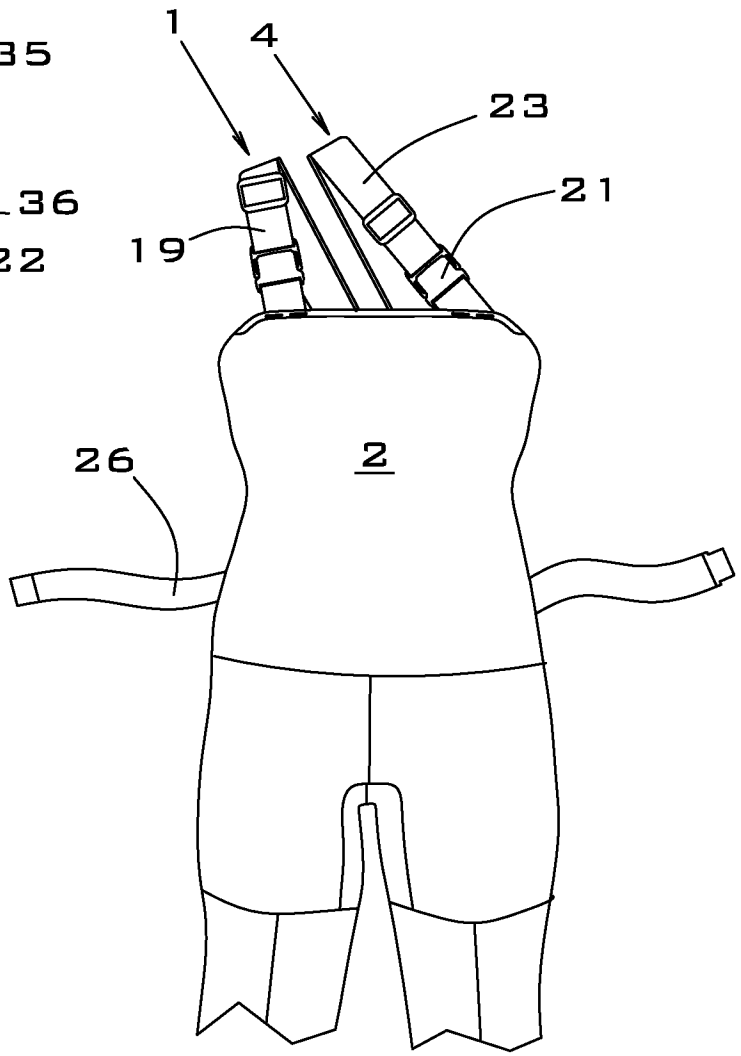
FIG. 7C is a front partial view of the present invention that further illustrates the positions of the first and second suspender assemblies in the auxiliary position.
Figure 7B:
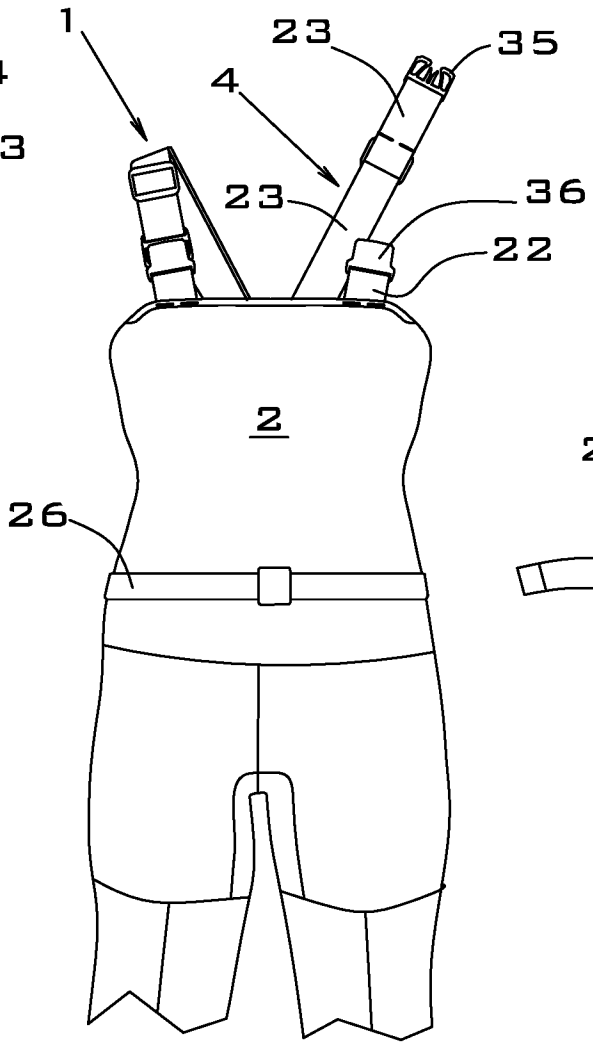
FIG. 7B is a front partial view of the present invention that illustrates the positions of the first and second suspender assemblies in an intermediate position.
Figure 7A:
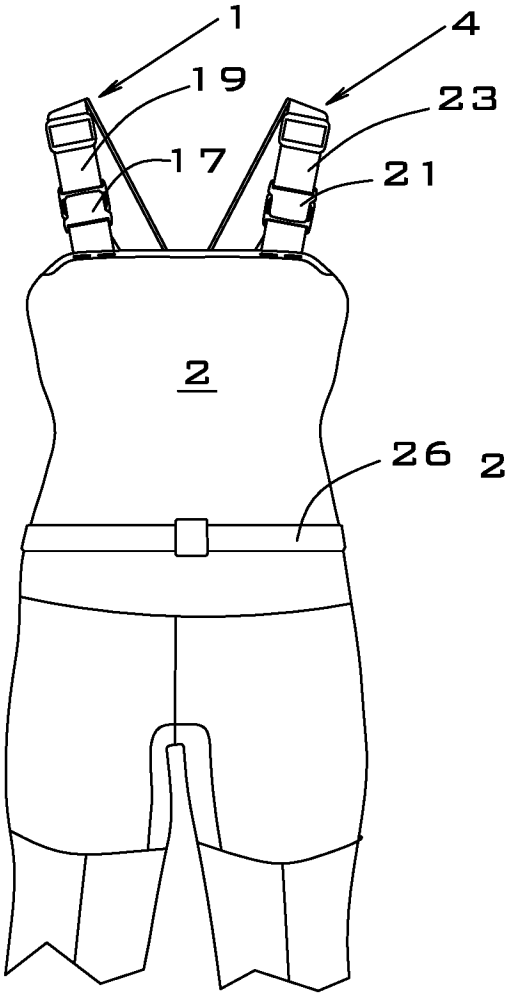
FIG. 7A is a front partial view of the present invention that further illustrates the positions of the first and second suspender assemblies in the normal position.

FIGS. 7A, 7B, and 7C are front partial views of the present invention that further illustrate the positions of the first and second suspender assemblies 1, 4 when the second suspender assembly 4 is moved from the normal to the auxiliary position. FIG. 7A shows the first and second suspender assemblies 1,4 in the normal position (as shown in FIG. 6A) with the first suspender strap 19 positioned so as to fit over a wearer's right shoulder, and the second suspender strap 23 positioned so as to fit over the wearer's left shoulder.

FIG. 7B shows the second suspender assembly 4 in an intermediate position, as would occur when the wearer has opened the second quick-release buckle 21 (shown in FIG. 7A) and is passing the second suspender strap 23 behind the head. In this position, the male half 35 of the second quick-release buckle 21 remains attached to the second suspender strap 23, while the female half 36 of the second quick-release buckle 21 remains attached to the chest piece 2 via the second attachment loop 22.

FIG. 7C shows the second quick-release buckle 21 reconnected, so that both the first suspender strap 19 and the second suspender strap 23 would be positioned over the wearer's right shoulder, as illustrated in FIG. 6B. The wader belt 26 is shown as having been opened but is being retained by the belt loops 27, 28 (shown in FIG. 2) so that the wader can be unzipped and partially removed. If an outer jacket is worn over the wader, the second suspender assembly 4 may be shifted from the normal to the auxiliary position without requiring the jacket to be removed.

The first and second quick-release buckles 17, 21 are preferably of similar configuration, but are attached to their respective suspender assemblies 1, 4 in opposite directions; i.e., the female half of the first quick-release buckle 17 is attached to the chest piece 2, while the male half of the second quick-release buckle 21 is attached to the chest piece 2. This arrangement makes it easy for the wearer to quickly identify the left and right suspender assemblies when donning the wader and connecting the first and second quick-release buckles 17, 21.

FIGS. 8 and 9 illustrate the position of the present invention when it has been partially removed and the wearer has assumed a squatting position in order to perform bathroom functions. FIG. 8 is a left side view of the present invention showing how the top of the wader may be pulled down over the buttocks of the wearer when the zipper 25 has been unzipped, the belt 26 has been opened, and the second suspender assembly 4 (shown in FIG. 9) has been moved to the auxiliary position.

FIG. 9 is a right side view of the present invention showing how the top of the wader may be pulled down over the buttocks of the wearer when the zipper 25 (shown in FIG. 8) has been unzipped, the wader belt 26 has been opened, and the second suspender assembly 4 has been moved to the auxiliary position, with both the first suspender assembly 1 and the second suspender assembly 4 positioned over the right shoulder of the wearer. FIGS. 8 and 9 show the first and second shoulder strap assemblies 1,4 being worn over the outside of a wearer's jacket 37; however, the present invention may also be partially removed in the manner described to perform bathroom functions if the first and second shoulder strap assemblies 1,4 are worn underneath the jacket.

FIG. 10 is a pattern layout showing the fabric pieces of the present invention laid flat, and positioned relative to each other as when just prior to being sewn together. The zipper 25 is positioned between the chest piece 2 and the left back piece 6 as shown. Although the edges of the chest piece 2 and the left back piece 6 that attach to the zipper 25 appear to be curved when the two pieces are laid out flat as in FIG. 10, these edges form straight seams along the left and right sides of the zipper 25 when the pieces are assembled to form a three-dimensional wader, as shown in FIG. 3. Also shown in FIG. 10 is an optional pocket back piece 38. With this design, the left back piece 6 is a mirror image of the right back piece 5, the left lower front torso piece 8 is a mirror image of the lower right torso piece 7, and the left lower back torso piece 10 is a mirror image of the right lower back torso piece 9. The outer right leg piece 11 and the inner right leg piece 12 are identical. The outer left leg piece 13 is a mirror image of the outer right leg piece 11, and the inner left leg piece 14 is a mirror image of the inner right leg piece 12. The positions of the right belt loop 27 on the exterior side and the fourth attachment loop 32 on the interior side of the right back piece 5 are shown. The positions of the left belt loop 28 on the exterior side and the third attachment loop 30 on the interior side of the left back piece 6 are also shown. The front piece 2 may comprise two optional hand-access openings 39 to an optional interior pocket (not shown).

Figure 11:
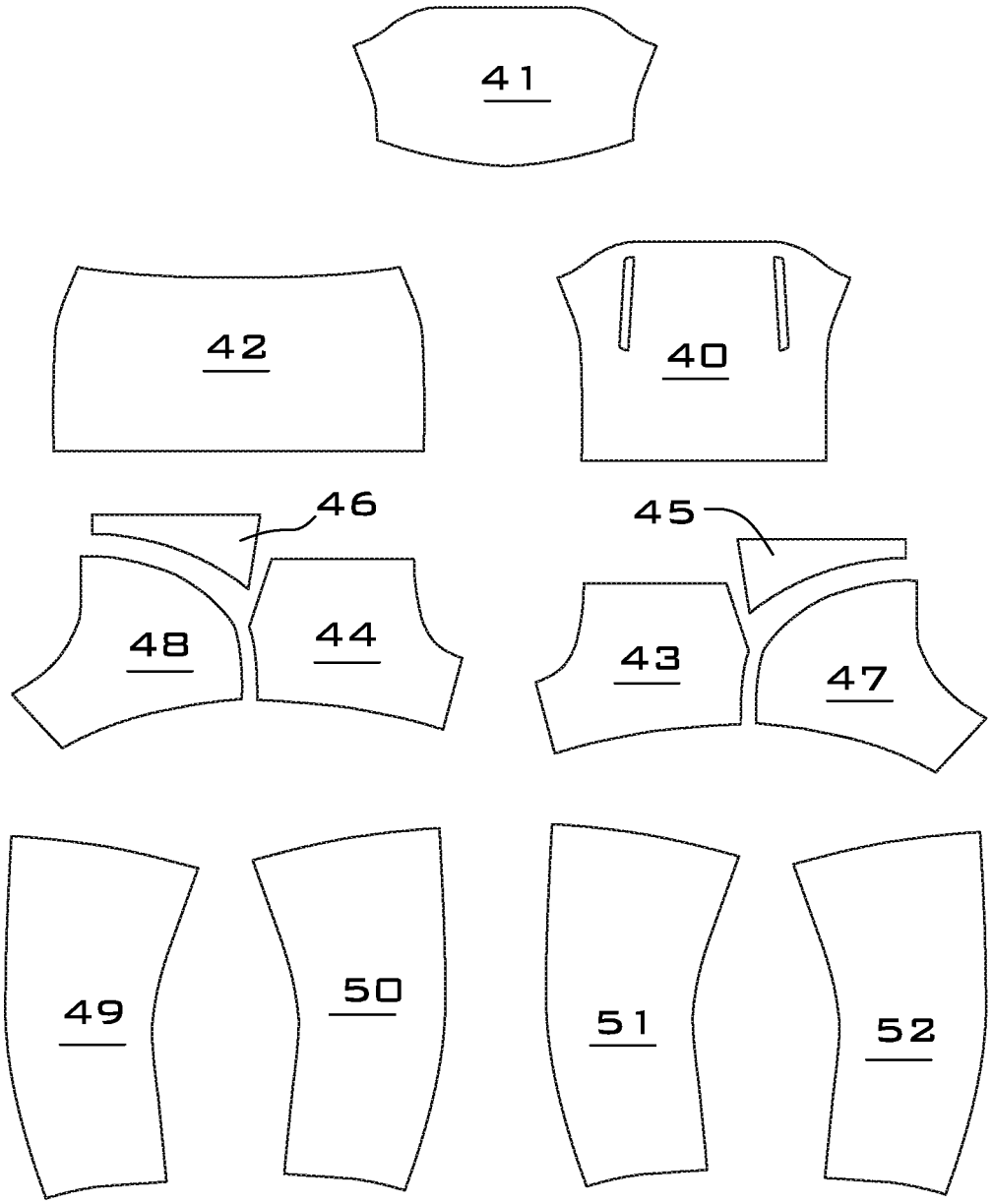
FIGURE 11 PRIOR ART
FIG. 11 is a pattern layout of a prior-art women's wader that does not comprise a side zipper, with the pieces laid out flat and positioned relative to each other as when just prior to being sewn together.

FIG. 11 is a pattern layout of a prior-art women's wader that does not comprise a side zipper, with the pieces laid out flat and positioned relative to each other as when just prior to being sewn together This pattern comprises a chest piece 40, an optional pocket back piece 41, and a single-piece upper back torso piece 42. The pattern further comprises a right lower front torso piece 43 and its mirror image left lower front torso piece 44, a right yoke piece 45 and its mirror image left yoke piece 46, a right lower back torso piece 47 and its mirror image left lower back torso piece 48. The pattern further comprises a right outer leg piece 49 and an identical right inner leg piece 50, an left outer leg piece 51 that is a mirror image of the right outer leg piece 49, and an left inner leg piece 52 that is a mirror image of the right inner leg piece 50.

The present invention has several manufacturing advantages over the prior art, as illustrated in FIGS. 10 and 11. First, the present invention eliminates the right yoke piece 45 and the left yoke piece 46 of the prior art, thereby reducing the cutting and sewing time and resulting in a cost saving in labor. Second, the zipper of the present invention allows the wader to be made with a trimmer fit than the prior art wader while still fitting around the widest portion (the hips) of the wearer, thereby requiring less material for the chest piece 2, the right back piece 5, and the left back piece 6, as compared to the material required for the chest piece 40 and the back piece 42 of the prior art, which results in a saving in material cost.

Figure 12:
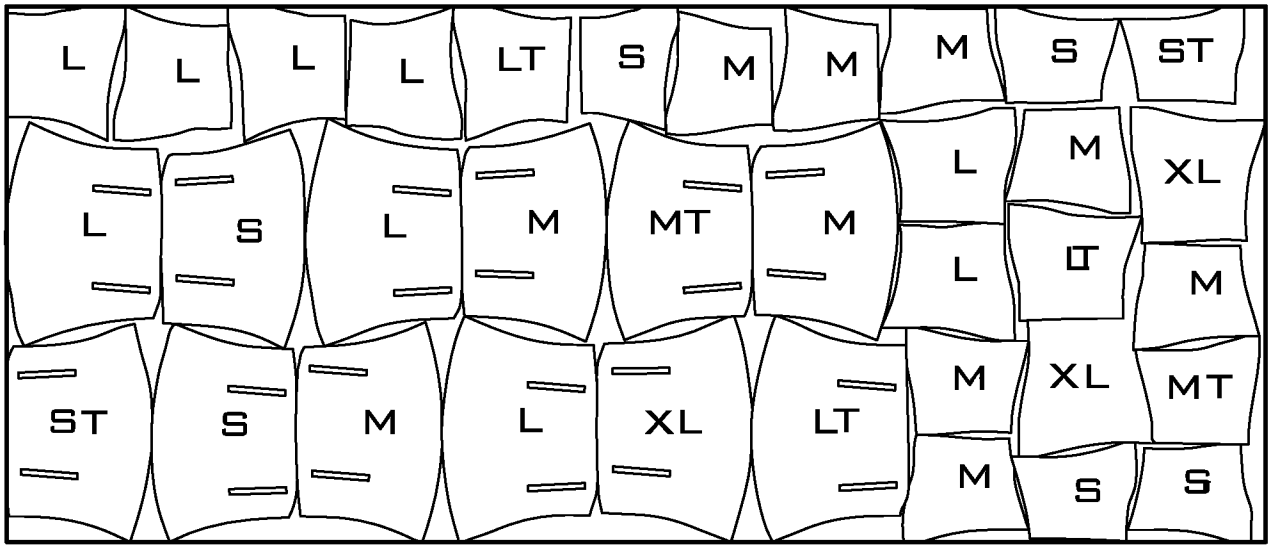
FIG. 12 illustrates multiple upper torso pieces of the present invention with the pieces laid out on a sheet of waterproof fabric prior to cutting.
Figure 13:
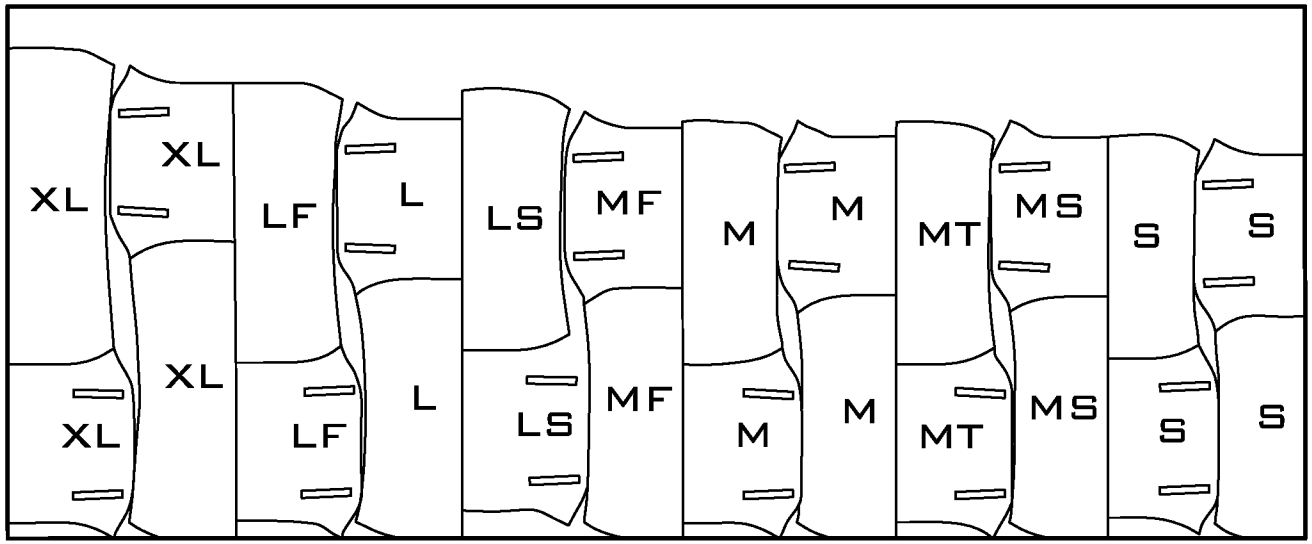
FIGURE 13 PRIOR ART
FIG. 13 illustrates multiple upper torso pieces of a prior art zipperless wader with the pieces laid out on a sheet of waterproof fabric prior to cutting.

FIGS. 12 and 13 illustrate multiple upper torso pieces of the present invention and the prior art, respectively, with each laid out on a sheet of waterproof fabric prior to cutting. (The leg pieces of the present invention and the prior art are similar and are not shown). In both figures, the pieces have been laid out so as to minimize wasted fabric. In these drawings, S=small, M=medium, L=large, XL=extra large, ST=small tall, MT=medium tall, LT=large tall, LS=large short, XLF=extra large full, LF=large full. MS=medium short, MF=medium full. As shown in a comparison of FIG. 12 with FIG. 13, the pieces of the present invention (FIG. 12) fit together on the sheet of fabric more efficiently than pieces of the prior art (FIG. 13), allowing more pieces to be fit on a standard sheet of material. Using a standard fabric width of 56 inches, the upper torso pieces of the present invention have a yield of 0.3024 yards of fabric per unit, as compared to a yield of 0.3814 yards of fabric per unit for the upper torso pieces of the prior art. The better fit of pieces onto the fabric of the present invention, as shown in FIGS. 12 and 13, illustrates a third advantage of the present invention over the prior art, which is a material cost savings due to a reduction in wasted material.

Figure 15:
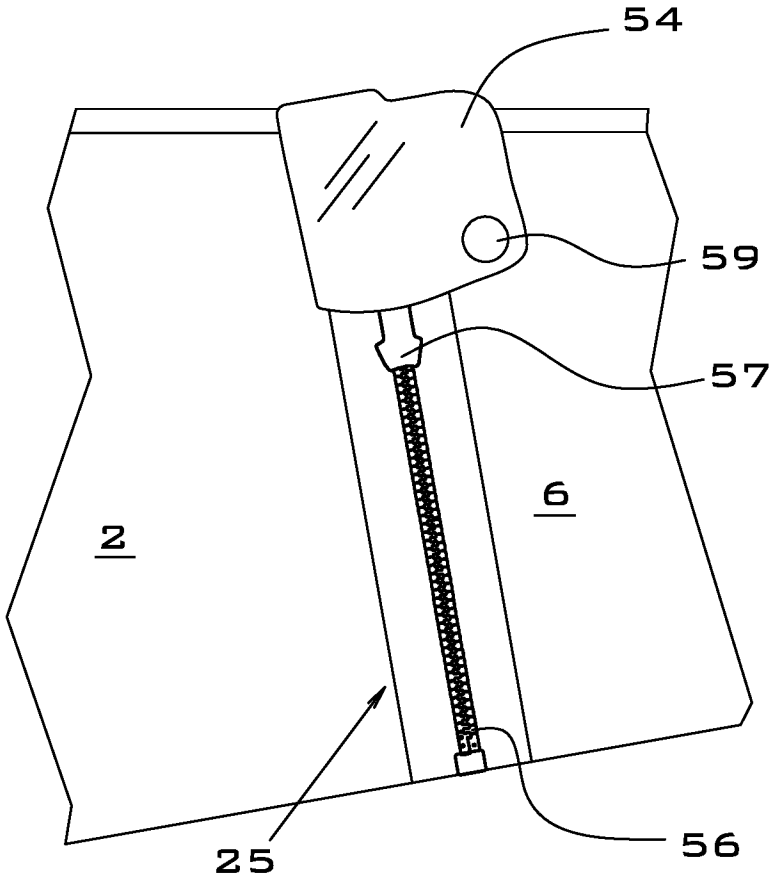
FIG. 15 is a detail side view of the external surface of the zipper showing a top flap of the internal zipper cover.
Figure 14:
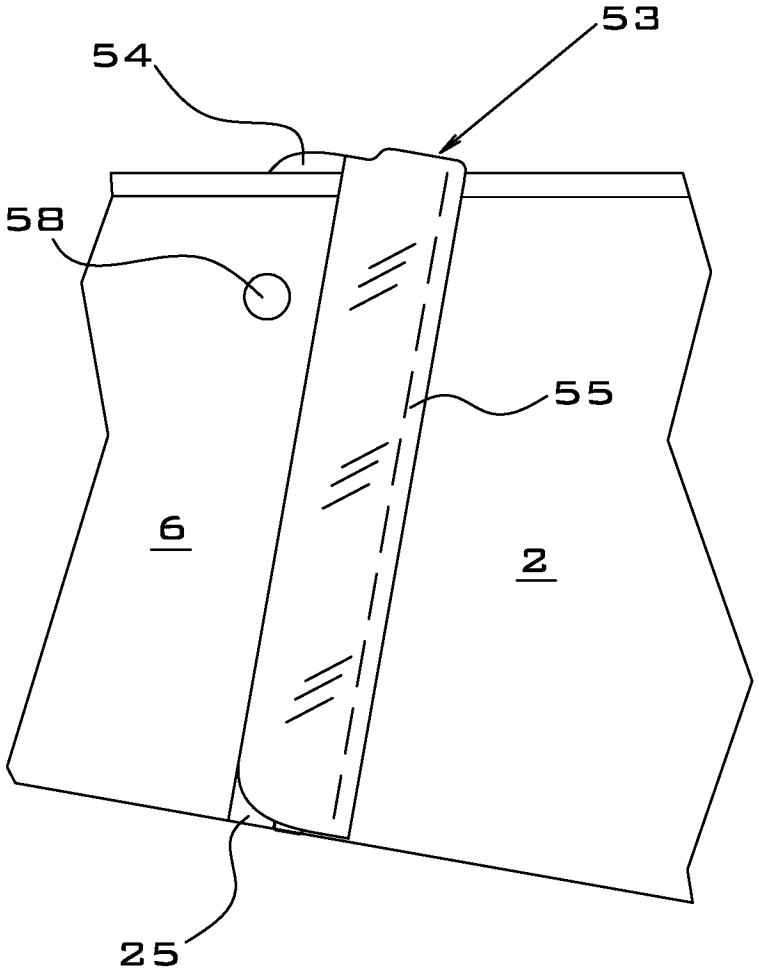
FIG. 14 is a detail side view of the interior surface of the zipper shown covered by an internal zipper flap.

FIG. 14 is a detail side view of the interior surface of the zipper 25 shown covered by an internal zipper flap cover 53. FIG. 15 is a detail side view of the external surface of the zipper 25 showing a top flap 54 of the internal zipper flap cover 53. As shown in FIG. 14, the internal zipper flap cover 53 is comprised of a generally rectangular piece of fabric that is bonded to the seam between the zipper 25 and the chest piece 2 with a strip of adhesive 55 (illustrated by the dashed line). The internal zipper flap cover 53 is sized and positioned so that the zipper teeth 56 are covered by the zipper flap cover 53 when the zipper 25 is zipped up, thereby preventing clothing from snagging on the zipper 25. As shown in FIG. 15, the top flap 54 of the internal zipper flap cover 53 folds over the top of the zipper 25 and extends over the top portion of the exterior surface of the zipper 25, thereby covering a portion of the pull tab 57 of the zipper when the zipper 25 is zipped up, which prevents the top portions of the zipper from snagging fly line, clothing, or other objects. The top flap 54 is held in place with a snap closure. The interior face 58 of the snap closure is shown in FIG. 14, and the exterior face 59 of the snap closure is shown in FIG. 15.

Although the preferred embodiment of the present invention has been shown and described, it will be apparent to those skilled in the art that many changes and modifications may be made without departing from the invention in its broader aspects. The appended claims are therefore intended to cover all such changes and modifications as fall within the true spirit and scope of the invention.

We claim:

1. A fishing wader comprising:

(a) a chest piece;

(b) a right back piece;

(c) a left back piece;

(d) a first suspender assembly; and (e) a second suspender assembly;

wherein the first suspender assembly comprises a front end that is connected to a top portion of a right side of the chest piece and a back end that is connected to an inside surface of a the left back piece;

wherein the second suspender assembly comprises a front end that is connected to a top portion of a left side of the chest piece and a back end that is connected to an inside surface of the right back piece; and wherein a waterproof zipper is installed between a left side of the chest piece and a left side of the left back piece;

wherein the first suspender assembly comprises a first quick-release buckle, a first attachment loop, a first suspender strap, and a first length adjustment buckle; and wherein the second suspender assembly comprises a second quick-release buckle, a second attachment loop, a second suspender strap, and a second length adjustment buckle;

wherein the first suspender strap comprises a rear terminal end that is connected to an upper end of a first strap replacement buckle;

wherein a lower end of the first strap replacement buckle is connected to a third attachment loop;

wherein the third attachment loop is located on a left central side of the left back piece;

wherein the second suspender strap comprises a rear terminal end that is connected to an upper end of a second strap replacement buckle;

wherein a lower end of the of the second strap replacement buckle is connected to a fourth attachment loop;

wherein the fourth attachment loop is located on a right central side of the right back piece;

wherein a piece of webbing is attached to the top edges of the center portions of the right back piece and left back piece to form a slot through which the first suspender strap and the second suspender strap pass; and wherein the slot is wider than the first and second suspender straps, thereby allowing the first and second suspender straps to slide laterally back and forth within the slot.

* * * * *